United States Patent [19]

Auyer et al.

[11] Patent Number: 5,014,593

[45] Date of Patent: May 14, 1991

[54] PERFORATED PLATE ARMOR

[75] Inventors: Richard A. Auyer, Troy; Robert J. Buccellato, Livonia; Andrew J. Gidynski, Sterling Heights; Richard M. Ingersoll, Troy; Needangalam S. Sridharan, Ortonville, all of Mich.

[73] Assignee: General Dynamics Land Systems, Inc., Troy, Mich.

[21] Appl. No.: 423,657

[22] Filed: Oct. 18, 1989

Related U.S. Application Data

[63] Continuation of Ser. No. 162,555, Mar. 1, 1988, abandoned.

[51] Int. Cl.[5] ..... F41H 5/013; F41H 5/04

[52] U.S. Cl. ..... 89/36.02; 109/84

[58] Field of Search ..... 89/36.02, 36.01, 36.04, 89/36.08, 36.12; 428/911, 71, 73; 109/79, 82, 84; 52/309.9, 309.11

[56] References Cited

U.S. PATENT DOCUMENTS

| | | | |
|---|---|---|---|
| 45,536 | 12/1864 | Terwilliger et al. | 109/85 |
| 774,959 | 11/1904 | Tresidder | 89/36.02 |
| 874,729 | 12/1907 | DeBobula | 109/83 |
| 1,043,416 | 11/1912 | Giolitti | 89/36.02 |
| 1,079,323 | 11/1913 | Benthall | 89/36.02 |
| 1,097,573 | 5/1914 | Wales | 89/36.02 |
| 1,548,441 | 8/1925 | Branovich | 220/461 |
| 1,563,420 | 12/1925 | Johnson et al. | 148/12.1 |
| 1,995,484 | 3/1935 | Sullivan | 148/318 |
| 2,348,130 | 5/1944 | Hardy, Jr. | 109/84 |
| 2,733,177 | 1/1956 | Meyer | 89/36.02 |
| 3,357,146 | 12/1967 | Gartrell | 52/309.11 |
| 3,444,033 | 5/1969 | King | 89/36.01 |
| 3,708,380 | 1/1973 | Niebylski | 428/71 |
| 3,736,838 | 6/1973 | Butterweck et al. | 109/83 |
| 3,859,892 | 1/1975 | Coes | 89/36.02 |
| 4,178,859 | 12/1979 | Seiz et al. | 109/83 |
| 4,179,979 | 12/1979 | Cook et al. | 89/36.02 |
| 4,455,801 | 6/1984 | Merritt | 109/84 |
| 4,567,100 | 1/1986 | Pickett et al. | 109/82 |
| 4,571,909 | 2/1986 | Berghuis et al. | 52/309.11 |
| 4,716,810 | 1/1988 | DuGuvera | 89/36.02 |
| 4,835,033 | 5/1989 | Auyer et al. | 428/911 |
| 4,857,119 | 8/1989 | Karst et al. | 89/36.02 |

FOREIGN PATENT DOCUMENTS

| | | | |
|---|---|---|---|
| 36056 | 8/1908 | Austria | 109/79 |
| 2201637 | 8/1973 | Fed. Rep. of Germany | 89/36.02 |
| 3506004 | 8/1986 | Fed. Rep. of Germany | 428/71 |
| 866796 | 9/1941 | France | 89/36.02 |
| 909792 | 5/1946 | France | 89/36.02 |
| 1102646 | 10/1955 | France | 89/36.02 |
| 1566448 | 5/1969 | France | 89/36.02 |
| 2447272 | 8/1980 | France | 89/36.02 |
| 306191 | 12/1939 | Italy | 89/36.02 |
| 8404156 | 10/1984 | PCT Int'l Appl. | 428/911 |
| 543645 | 3/1942 | United Kingdom | 428/911 |
| 2107608 | 5/1983 | United Kingdom | 428/911 |

*Primary Examiner*—Charles T. Jordan
*Assistant Examiner*—Stephen Johnson
*Attorney, Agent, or Firm*—Brooks & Kushman

[57] ABSTRACT

Perforated plate armor (10) for protecting an object (12) from damage includes outer and inner perforated steel plates (14) and (18) which have associated patterns of holes (16,20). These perforated steel plates (14,18) are heat treated to have hardened surfaces and a more ductile core and are spaced with respect to each other at outer and inner locations with respect to the object (12) to be protected. The patterns of holes (16,20) of the perforated steel plates (14,18) are offset with respect to each other to prevent straight line penetration of any particle through both plates. An inner backing plate (28) preferably made of aluminum is also provided to stop any particles that might penetrate both perforated steel plates (14,18). Fillers (22,24) and connectors (26) space the outer and inner perforated steel plates (14,18) and the aluminum backing plate (28) with respect to each other.

9 Claims, 4 Drawing Sheets

PERFORATED PLATE ARMOR

This is a continuation of copending application Ser. No. 07/162,555 filed on Mar. 1, 1988, now abandoned.

TECHNICAL FIELD

This invention relates to steel armor plate for protecting objects such as vehicles from incoming objects or from other types of attack that can cause damage.

BACKGROUND ART

Armor plate of hardened steel has been used for many years to provide protection of objects against damage. Vehicles such as tanks, military sites, vaults, and safes, etc. have used steel armor plate to provide such protection.

In order to increase the protection provided, it has previously been proposed to use spaced layers of steel. For example, U.S. Pat. No. 1,548,441 Branovich discloses an armor protected fuel tank wherein a layer of wood and a layer of semi-cured rubber are positioned between a steel tank and an outer armor plate. U.S. Pat. No. 2,348,130 of Hardy, Jr. discloses spaced metal plates between which a layer of rubber is positioned with pockets in the rubber filled with abrasive material such as sand. U.S. Pat. No. 2,733,177 Meyer discloses an elastic cascading impact absorber wherein layers of armor are spaced with respect to each other by elastic material which is disclosed in preferred embodiment as being formed sheet metal springs. U.S. Pat. No. 4,455,801 Merritt discloses a lightweight vault wall wherein layers of metal, stainless steel and aluminum, cover spaced layers of plywood adjacent each of which is provided a layer of expanded metal mesh that is spaced from the other layer of expanded metal mesh by a foamed plastic core.

Two different basic types of armor plate are conventionally utilized at the present time. One type is high-hard armor that is extremely hard and thus capable of preventing penetration of penetrating type of projectiles. The other type is rolled homogenous armor that is somewhat softer than high-hard armor but is more ductile so as to prevent brittle fracture. Prior art references which disclose compositions and processing used in hardening of steel plates include: U.S. Pat. Nos. 774,959 Tresidder; 1,043,416 Giolitti; 1,079,323 Benthall; 1,097,573 Wales; 1,563,420 Johnson et al; and 1,995,484 Sullivan as well as the previously mentioned U.S. Pat. No. 2,733,177 Meyer.

In order to decrease weight, armor plate and the like have previously included holes such as illustrated by U.S. Pat. No. 3,763,838 of Butterweck et al which discloses a protective shielding for vehicles. While circular holes such as disclosed by Butterweck et al or slots are the easiest to produce in armor by punching, such shapes have ballistic gaps that reduce the protection provided. Similarly, square holes which will provide the lowest weight also have ballistic gaps that reduce the protection provided.

Other prior art references disclosing armor plate or the like include U.S. Pat. Nos.: 45,536 Terwilliger et al; 874,729 DeBolula; and 4,178,859 Seiz et al.

DISCLOSURE OF INVENTION

An object of the present invention is to provide perforated plate armor for protecting an object from damage by incoming projectiles.

In carrying out the above and other objects, perforated plate armor constructed in accordance with the present invention includes outer and inner perforated steel plates each of which has an associated pattern of spaced holes. Each of the steel plates is heat treated to have hardened surfaces and a more ductile core, and the steel plates are supported in a spaced relationship to each other at outer and inner locations with respect to an object to be protected. The hole patterns of the outer and inner perforated steel plates are offset with respect to each other so as to prevent straight line penetration of a projectile particle of any significant size through both plates.

In the preferred construction, the perforated plate armor also includes an inner backing plate for stopping any particles that pass through both perforated plates. This inner backing plate is preferably made from aluminum when taking into consideration both strength and weight factors.

A first filler is located between the spaced outer and inner perforated steel plates, and a second filler is located between the inner perforated steel plate and the aluminum backing plate. These fillers are made from any suitable lightweight material such as foam, plastic, or a lightweight wood like balsa wood.

Spacers separate the outer and inner perforated steel plates from each other and also space the inner perforated steel plate from the aluminum backing plate. These spacers are thus located in alignment with the fillers with a corresponding thickness for providing the plate spacing. Best results are achieved when the aluminum backing plate is spaced inwardly from the inner perforated steel plate a greater distance than the spacing between the outer and inner perforated steel plates, most preferably about five to seven times the spacing between the outer and inner plates.

Connectors are also provided for securing the outer and inner perforated steel plates to each other and to the backing plate with the spacers located between the plates. These connectors preferably extend through the spacers which have annular shapes such that the spacers extend between the outer and inner perforated steel plates and the aluminum backing plate to cooperate in the securement of all of the plates to each other in a spaced relationship.

As disclosed, the perforated plate armor also includes an integument in which the outer and inner perforated steel plates are enclosed. This integument preferably includes a fiberglass mat and a veil cloth covering the fiberglass mat.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
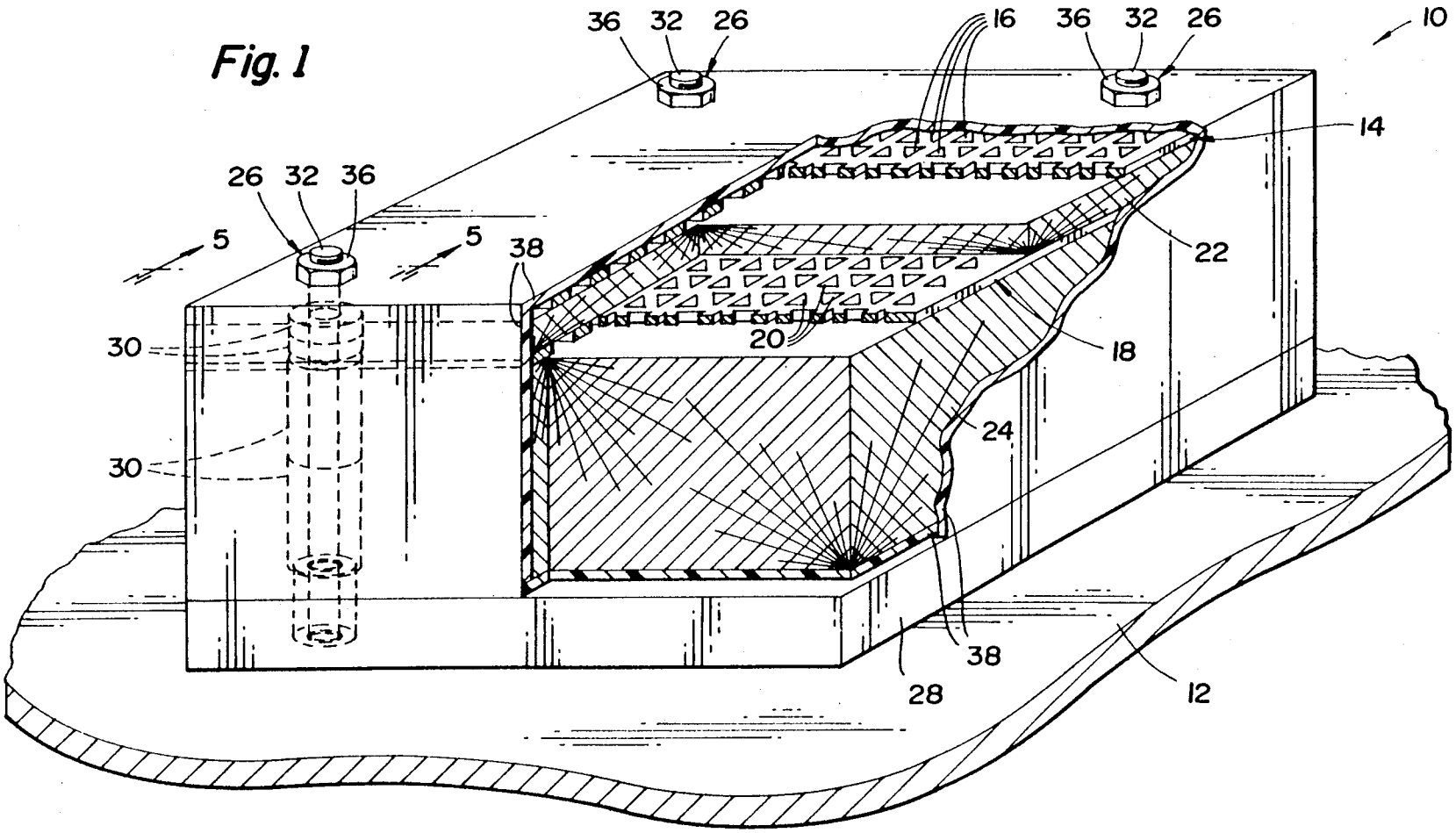
FIG. 1 is a perspective view that is partially broken away in section to illustrate an armor plate module including perforated armor plate embodying the present invention.
Figure 4:
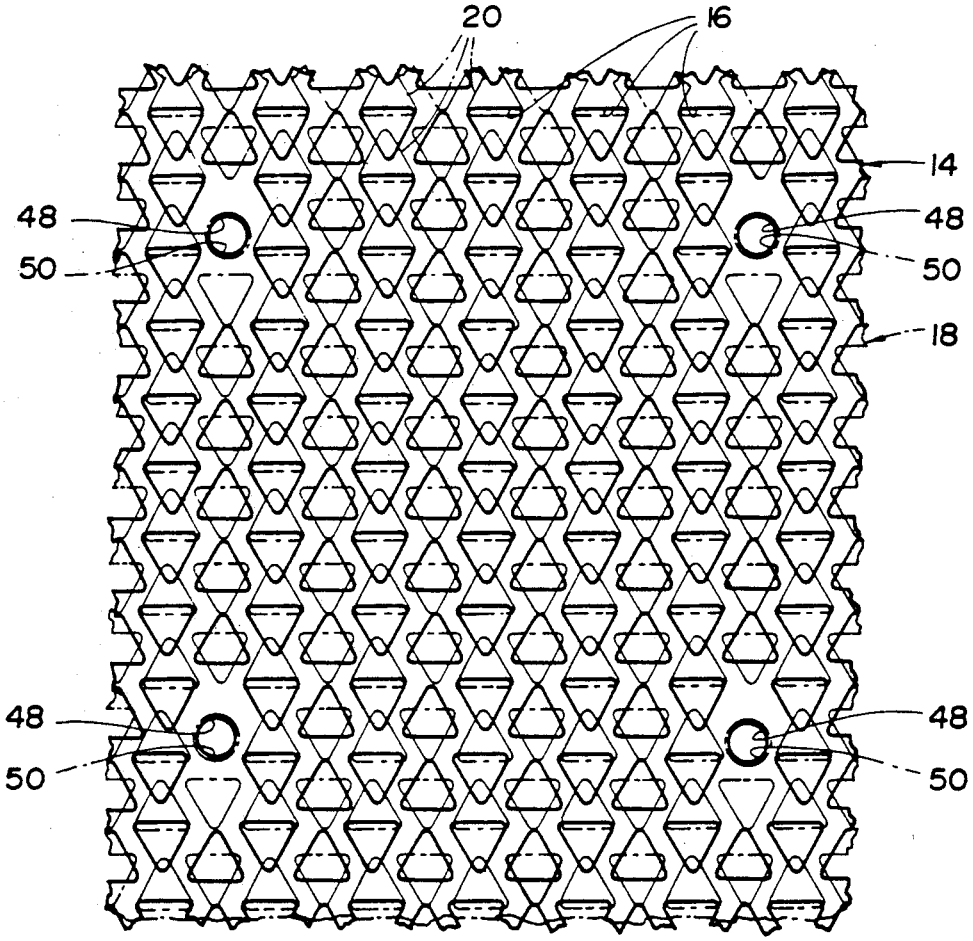
FIG. 4 is a plan view that illustrates an offset relationship of the hole patterns of the outer and inner steel plates of the armor plate module when mounted with respect to each other as illustrated in FIG. 1.
Figure 5:
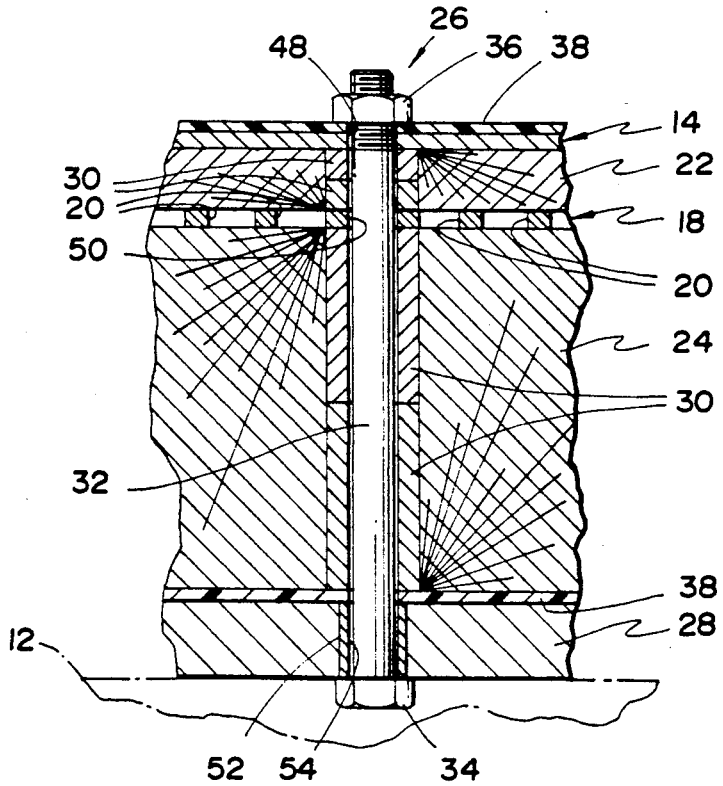
FIG. 5 is a sectional view taken along the direction of line 5—5 in FIG. 1 to illustrate the construction of connectors that connect the outer and inner steel plates to each other in a spaced relationship.

With reference to FIG. 1 of the drawings, an armor plate module generally indicated by 10 embodies the present invention as is hereinafter more fully described and provides protection for an object 12 such as the outer skin of a vehicle. The armor plate module 10 includes an assembly of perforated plate armor having an outer perforated steel plate 14 with a pattern of spaced holes 16. Armor plate module 10 also includes an inner perforated steel plate 18 having a pattern of spaced holes 20. As is hereinafter more fully described, each of the outer and inner steel plates 14 and 18 is heat treated to have hardened surfaces and a more ductile core. A pair of fillers 22 and 24 and connectors 26 provide a means for supporting the outer and inner perforated steel plates 14 and 18 in a spaced relationship to each other at outer and inner locations with respect to the object 12 to be protected. In this assembled condition, the pattern of holes 16 of the outer steel plate 14 and the pattern of holes 20 of the inner steel plate 18 are offset with respect to each other as illustrated in FIG. 4 to thereby cooperate in preventing a projectile from penetrating straight through both plates. Each of the outer and inner perforated steel plates 14 and 18 has oppositely facing surfaces as best shown in FIG. 5. The spaced holes 16 and 20 of the plates 14 and 18 each have a hole surface that extends between the oppositely facing surfaces of the plate about the entire periphery of the hole. This construction results in less material than an imperforate plate so as to thereby provide lightweight protection.

As shown in both FIGS. 1 and 5, the perforated plate armor provided by the module 10 also includes an inner backing plate 28 for stopping any particles that might pass through both perforated steel plates 14 and 18. This inner backing plate 28 is most preferably made from aluminum when taking into consideration both weight and strength factors.

The one filler 22 is located between the outer and inner perforated steel plates 14 and 18 to fill the spacing between these two plates, while the other filler 24 is located between the inner perforated steel plate 18 and the aluminum backing plate 28 to likewise fill the spacing between these two plates. Both of the fillers 22 and 24 can be made from any suitable material that is lightweight while still having the requisite strength such as foam, plastic, or a lightweight wood like balsa wood.

With combined reference to FIGS. 1 and 5, the connectors 26 include spacers 30 that space the outer and inner perforated steel plates 14 and 18 with respect to each other. As illustrated, each connector 26 includes a pair of the spacers 30 that space the outer and inner steel plates 14 and 18 with respect to each other and also includes a pair of spacers 30 that space the inner steel plate 18 with respect to the backing plate 28. It is also possible to utilize a single spacer for separating each of the adjacent pairs of plates; however, use of multiple spacers provides ease of adjustment of the plate spacing by merely adding or removing one or more spacers sized to provide best results. The spacers 30 have annular shapes through which a bolt 32 of the associated connector 26 extends between the outer and inner perforated steel plates 14 and 18 and the aluminum backing plate 28. A head 34 of bolt 32 is engaged with the backing plate 28 as illustrated, while a nut 36 threaded onto the bolt 32 holds the outer steel plate 14 as shown in FIG. 5.

With reference to FIG. 1, the armor plate module 10 also includes an integument 38 in which the outer and inner perforated steel plates 14 and 18 are enclosed along with the first and second fillers 22 and 24. This integument 38 preferably includes a fiberglass mat covered by a veil cloth and functions to encase the outer and inner perforated steel plates 14 and 18 and the first and second fillers 22 and 24 as a module in association with the connectors 26 that also secure the backing plate 28.

Figure 2:
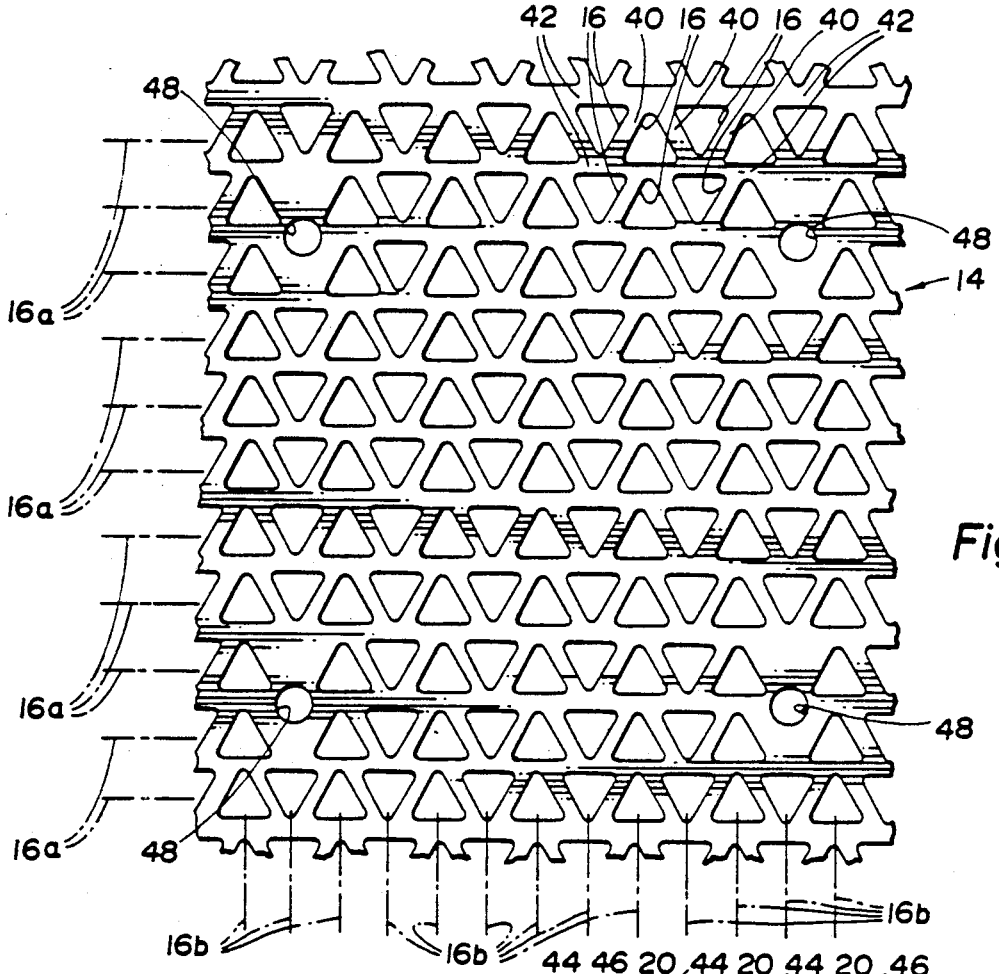
FIG. 2 is a plan view that illustrates the hole pattern of an outer steel plate of the armor plate module.
Figure 3:
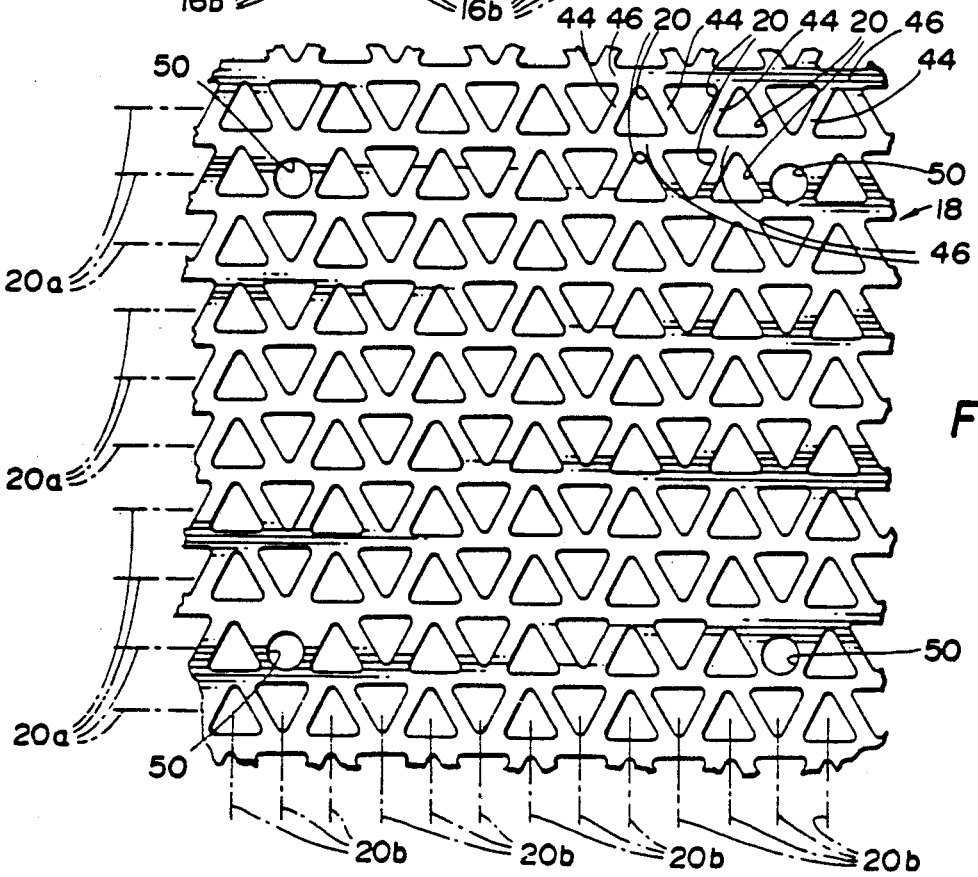
FIG. 3 is a plan view that illustrates the hole pattern of an inner steel plate of the armor plate module.

As illustrated in FIGS. 2 and 3, each of the hardened steel plates 14 and 18 has its associated holes 16 and 20 provided with triangular shapes that are arranged in a repeating pattern. Specifically, the triangular holes 16 of the outer perforated steel plate 14 shown in FIG. 2 are arranged in rows 16*a* and columns 16*b*. Webs 40 of the plate 14 separate the triangular holes 16 along each row 16*a*, while webs 42 separate the triangular holes 16 along each column 16*b*. Likewise, the inner steel plate 18 shown in FIG. 3 has its triangular holes 20 arranged in rows 20*a* and columns 20*b* in the same manner with webs 44 spacing the triangular holes 20 along each column 20*a* and with webs 46 spacing the triangular holes 20 along each column 20*b*. This construction of each steel plate 14 and 18 provides lightweight armor plate without ballistic gaps that would occur with other shapes such as round or slotted holes that are easier to form by a punching operation or with square holes that provide the most lightweight construction possible.

As shown in both FIGS. 2 and 3, the triangular holes 16 and 20 of each of the steel plates 14 and 18 are shaped and positioned with respect to each other such that the associated webs 40,42 and 44,46 are generally straight. The triangular holes 16 and 20 of each steel plate preferably have the same size and shape as each other and are most preferably constructed as equilateral triangles. Adjacent triangular holes 16 and 20 with the equilateral shapes along the rows 16*a* and 20*a* are rotated at 120° with respect to each other to provide the generally straight webs 40 and 44 between the adjacent triangular holes. Along the columns 16*b* and 20*b* of each steel plate, the associated triangular holes 16 and 20 have the equilateral shapes thereof provided with the same orientation and are separated from the adjacent triangular holes in the column by the generally straight webs 42 and 46.

Referring to FIG. 2, the outer steel plate 14 is provided with round mounting holes 48 that are positioned generally along the webs 42 that separate one of the rows 16*a* of triangular holes 16 from an adjacent row 16*a*. Each round mounting hole 48 is located in alignment with the triangular holes of one column 16*b* as well as being in alignment with the webs 42 that separate adjacent rows 16*a*.

As illustrated in FIG. 3, the inner steel plate 18 has round mounting holes 50 aligned along associated rows 20*a* of the triangular holes 20. These round mounting holes 50 are also aligned along associated columns 20*b*.

As shown in FIG. 5, the bolt 32 of each connector 26 extends through the round mounting holes 48 and 50 of the outer and inner perforated steel plates 14 and 18 as well as through a bushing 52 in a round mounting hole 54 of the aluminum backing plate 28 to provide the assembly as previously described. The offset hole relationship shown in FIG. 4 is provided by the combination of the location of the round mounting holes 48 of the outer plate 14 as shown in FIG. 2 in alignment with the webs 42 between the adjacent rows 16*a*, the location of the mounting holes 50 of the inner steel plate 18 in alignment with the rows 20*a*, and rotation of the outer steel plate 14 180° from the position shown in FIG. 2 with respect to the inner steel plate 18 shown in FIG. 3. This offset relationship of the hole patterns prevents straight line penetration of any projectile of any significant size through both steel plates.

In one preferred embodiment of the armor plate module 10, the outer steel plate 14 has a thickness of about ⅜ of an inch and the inner steel plate 18 has a thickness of about ¼ of an inch while the first filler 22 has a thickness of about 1 inch and the second filler 24 has a thickness of about 5 to 7 inches. Both the outer and inner steel plates 14 and 18 have their equilateral triangular holes provided with the same size whose sides when extended at the rounded vertices thereof have a length with the intersecting adjacent sides of about 0.6495 inch such that the maximum circular shape that can pass through each hole has a diameter of ⅜ of an inch. The center of the holes are uniformly spaced along the rows 16*a* and 20*a* by a distance of 0.5540 of an inch, while the centers of the holes are uniformly spaced along the columns 16*b* and 20*b* by a distance of 0.6945 of an inch. The webs 40 and 44 between the triangular holes along each row 16*a* (FIG. 2) and 20*a* (FIG. 3) have a width of about 0.1985 inches. Between the adjacent rows 16*a* shown in FIG. 2 and and the adjacent rows 20*a* shown in FIG. 3, the sides of the triangular holes 16 and 20 are spaced from each other by about 0.1320 of an inch with a somewhat greater spacing being provided between each side and the adjacent hole apex due to its rounding. The mounting holes 48 and 50 of each steel plate are spaced from each other by seven rows from each other such that their centers are spaced by about 4.8615 inches along the length of each column. Furthermore, the mounting holes 48 and 50 are spaced from each other by ten columns such that their centers are located about 5.54 inches from each other along each row.

As is hereinafter more fully described, each of the steel plates 14 and 18 previously described is heat treated to provide carbonitride surfaces and a tough, ductile core. The carbonitride surfaces have a hardness of at least 66 on the Rockwell C scale to prevent surface penetration, while the tough, ductile core which is softer than the carbonitride surfaces prevents brittle fracture of the steel plate. More preferably, the carbonitride surfaces have a surface hardness of at least 67 on the Rockwell C scale to provide greater resistance to penetration.

It is possible to manufacture the plate armor from steel plates of the rolled homogenous type. With rolled homogenous armor, the core hardness is in the range of about 45 to 50 on the Rockwell C scale. Many types of rolled homogenous armor are available for use and have the general composition shown by the following Table I.

TABLE I

| Element | | Maximum range percent | Maximum limit percent |
|---|---|---|---|
| Carbon | | 0.10 | 0.28 |
| Manganese: | Up to 1.00% incl. | 0.30 | — |
| | Over 1.00% | 0.40 | — |
| Phosphorus | | — | 0.025 |
| Sulfur | | — | 0.025 |
| Silicon: | Up to 0.60% incl. | 0.20 | — |
| | Over 0.60% to 1.00% incl. | 0.30 | — |
| | Over 1.00% | 0.40 | — |
| Nickel | | 0.50 | — |
| Chromium: | Up to 1.25% incl. | 0.30 | — |
| | Over 1.25% | 0.40 | — |
| Molybdenum: | Up to 0.20% incl. | 0.07 | — |
| | Over 0.20% | 0.15 | — |
| Vanadium: | | 0.15 | — |

It is also possible to manufacture the plate armor from steel plate that is made from high-hard armor. With high-hard armor, the steel plate will have a core hardness in the range of about 52 to 54 on the Rockwell C scale. High-hard armor is also commercially available with the general composition as shown by the following Table II.

TABLE II

| Element | | Maximum range percent | Maximum limit percent |
|---|---|---|---|
| Carbon | | 0.10 | 0.32 |
| | 0 | | |
| Manganese: | Up to 1.00% incl. | 0.30 | — |
| | Over 1.00% | 0.40 | — |
| Phosphorus | | — | 0.025 |
| Sulfur | | — | 0.025 |
| Silicon: | Up to 0.60 incl. | 0.20 | — |
| | Over 0.60% to 1.00% incl. | 0.30 | — |
| Nickel | | 0.50 | — |
| Chromium: | Up to 1.25% incl. | 0.30 | — |
| | Over 1.25% | 0.40 | — |
| Molybdenum: | Up to 0.20% incl. | 0.07 | — |
| | Over 0.20% | 0.15 | — |
| Vanadium: | | 0.15 | — |

The thickness of steel plate utilized to provide the case hardened plate armor is in the range of about 0.15 to 0.5 of an inch. Also, the thickness of the carbonitride surfaces do not have to be particularly deep, about 0.016 of an inch is sufficient to provide the requisite surface hardness that is supported by the tougher, more ductile core. While carbonitride surfaces have previously been utilized to provide greater resistance to wear, such as on rotary shaft wear surfaces, such hardening has never been previously utilized to provide case-hardened plate armor in the manner herein disclosed.

As disclosed, the plate armor has the holes formed therethrough prior to the heat treating. As previously mentioned, it is preferable for the holes to have the same size and shape as each other arranged in the type of repeating pattern previously described. Also, the webs between the holes preferably have a width in the range of about 0.1 to 0.25 of an inch to provide best results.

Figure 6:
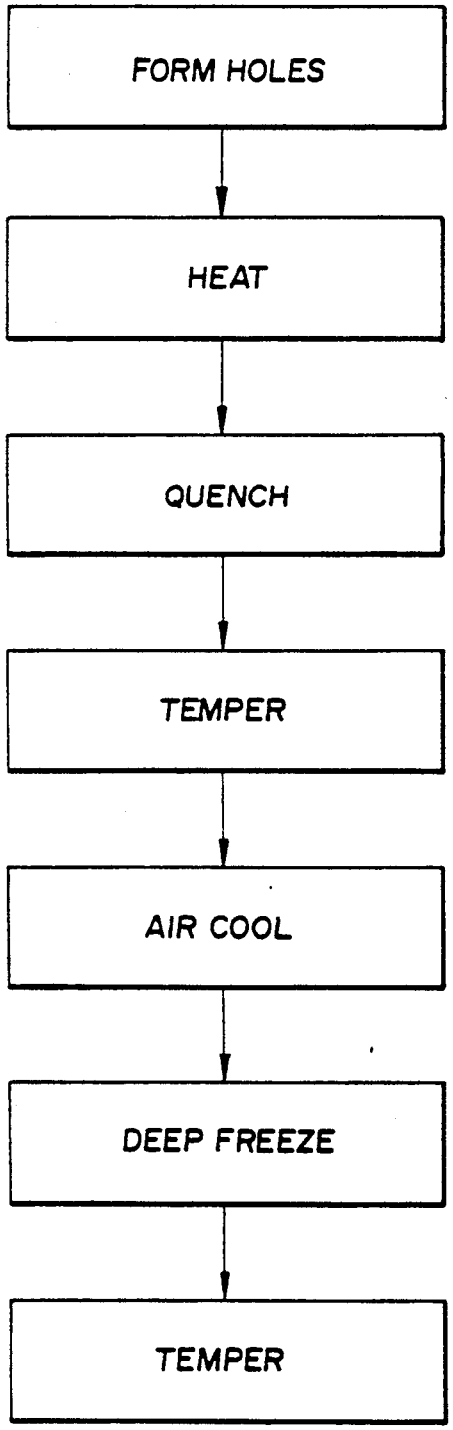
FIG. 6 is a schematic view that illustrates processing used to provide the steel plates of the armor plate module.

The process for performing the case hardening of the steel plate can be best understood by reference to FIG. 6. This process begins by forming the holes prior to the heat treating. While it is preferable to form the holes by a punching operation, it is also possible to provide the holes by drilling, laser cutting, electron beam cutting or any other type of process capable of accurately providing holes through the steel plate.

After the formation of the holes, the steel plate is heated in an atmosphere of nitrogen and carbon to provide the carbonitride surfaces. Cracked ammonia and methane are preferably utilized to readily provide the atmosphere of nitrogen and carbon. The heating in this atmosphere is performed for about 1 to 3 hours at a temperature in range of about 1300° F. to 1550° F., with the time being more critical than the temperature in controlling the degree of hardening achieved.

After the initial heating, the steel plate is quenched to form martensite. This quenching is preferably performed with oil to prevent distortion and to also insure that all of the austenite is changed to martensite.

After the quench, the steel plate is tempered to change the martensite to tempered martensite and ferrite. This tempering of the steel plate is preferably performed for ½ to 2 hours at a temperature in the range of 275° F. to 325° F. in order to effect the change of the martensite to the tempered martensite and ferrite.

An air cool of the steel plate after the initial tempering precedes a deep freeze step to permit cooling to the ambient without any expenditure of energy. The deep freeze step is then performed to change any retained austensite to martensite. This deep freezing is preferably performed for 1 to 3 hours at a temperature in the range of −50° F. to −150° F.

After the deep freeze step, the steel plate is again tempered to change any additional martensite resulting from the deep freezing to tempered martensite and ferrite. This additional tempering like the initial tempering is preferably performed for ½ to 2 hours at a temperature in the range of 275° F. to 325° F.

The carbonitride processing described above provides hard carbonitride surfaces and a softer but more ductile core such that the resultant steel plate is resistant to fracture as described above.

While the best mode for carrying out the invention has been described in detail, those familiar with the art to which this invention relates will recognize various alternative designs and embodiments for carrying out the invention as defined by the following claims.

What is claimed is:

1. Perforated plate armor comprising: an outer perforated steel plate having a pattern of spaced triangular holes an inner perforated steel plate having a pattern of spaced triangular holes; each of said outer and inner perforated steel plates having oppositely facing surfaces and having hole defining surfaces; the hole defining surfaces of each of said inner and outer steel plates extending between the oppositely facing surfaces of the associated plate about the entire periphery of each triangular hole therein; each of said outer and inner perforated steel plates being heat treated to have hardened surfaces and a more ductile core; an inner backing plate; each of said outer and inner perforated steel plates and said inner backing plate having mounting holes; connectors each of which includes a connector member that extends through a pair of said mounting holes in the outer and inner perforated steel plates and through one of said mounting holes in the inner backing plate; each of said connectors including spacers that are separate from each other and said spacers having openings through which the connector member thereof extends with at least one spacer of said spacers located between the outer and inner perforated steel plates and with at least one spacer of said spacers located between the inner perforated steel plate and inner backing plate; the connector member of each connector having a pair of ends where the connector member respectively extends through one mounting hole of said mounting holes of the outer perforated steel plate and through one mounting hole of said mounting holes of the inner backing plate to provide engagement of the outer and inner perforated steel plates and the inner backing plate with the spacers; and the connectors locating the outer and inner steel plates with the pattern of spaced triangular holes of the outer steel plate in an offset relationship to the pattern of spaced triangular holes of the inner steel plate to limit projectile penetration.

2. Perforated plate armor as in claim 1 wherein the inner backing plate is made of aluminum.

3. Perforated plate armor as in claim 2 further including a filler located between the inner perforated steel plate and the aluminum backing plate.

4. Perforated plate armor as in claim 3 wherein the filler is selected from a group consisting of foam, plastic, and wood.

5. Perforated plate armor as in claim 4 further including a filer located between the outer and inner perforated steel plates.

6. Perforated plate armor as in claim 5 wherein the filler between the outer and inner perforated steel plates is selected from a group consisting of foam, plastic, and wood.

7. Perforated plate armor as in claim 1 further including an integument in which the inner and outer perforated steel plates and the inner backing plate are enclosed.

8. Perforated plate armor as in claim 7 wherein in the integument includes a fiberglass mat.

9. Perforated plate armor as in claim 8 wherein in the integument also includes a veil cloth covering the fiberglass mat.

* * * * *